United States Patent [19]

Tsuchida et al.

[11] Patent Number: 5,023,973

[45] Date of Patent: Jun. 18, 1991

[54] VACUUM CLEANER

[75] Inventors: Yasuyuki Tsuchida, Hyogo; Yuki Nakanishi, Kasai, both of Japan

[73] Assignee: Sanyo Electric Co., Ltd., Osaka, Japan

[21] Appl. No.: 452,594

[22] Filed: Dec. 18, 1989

[30] Foreign Application Priority Data

Dec. 19, 1988 [JP] Japan ..... 63-320938

[51] Int. Cl.[5] ..... A47L 9/28

[52] U.S. Cl. ..... 15/319; 15/339; 15/412

[58] Field of Search ..... 15/319, 339, 412

[56] References Cited

U.S. PATENT DOCUMENTS 4,514,874 5/1985 Kurz ..... 15/339 X
4,654,924 4/1987 Getz et al. ..... 15/319
4,852,208 8/1989 Morishita et al. ..... 15/339

FOREIGN PATENT DOCUMENTS 285801 10/1988 European Pat. Off. ..... 15/319
320878 6/1989 European Pat. Off. ..... 15/319
3243723 7/1983 Fed. Rep. of Germany ..... 15/339
203462 10/1983 Fed. Rep. of Germany ..... 15/319

*Primary Examiner*—Chris K. Moore
*Attorney, Agent, or Firm*—Darby & Darby

[57] ABSTRACT

A vacuum cleaner includes a cleaner body provided with an air inlet and an air outlet, a dust chamber provided in the cleaner body and communicating with the air inlet, a housing provided in the cleaner body, communicating with the dust chamber and the air outlet and accommodating an electric air blower, a suction force level selector for the electric air blower, a pressure sensor provided on the suction side of the electric air blower, a comparator for comparing an output of a detected pressure from the pressure sensor with a reference value, a varying device for varying the reference value in proportion to the selected suction force level, and an indicator for indicating an accumulated state of dust in the dust chamber based upon the comparison result from the comparator.

7 Claims, 18 Drawing Sheets

FIG. 6

| STEP | H2 | H1 | M | L | LL | SM1 | SM2 | SM3 | DH1 | DH2 | NUMBER OF REPEAT |
|---|---|---|---|---|---|---|---|---|---|---|---|
| 1 | | | | | O | | | | | | ONE TIME |
| 2 | | | | O | O | | | | | | |
| 3 | | | O | O | O | | | | | | |
| 4 | | O | O | O | O | | | | | | |
| 5 | O | O | O | O | O | | | | | | |
| 6 | | O | O | O | O | | | | | | |
| 7 | | | O | O | O | | | | | | |
| 8 | | | | O | O | | | | | | |
| 9 | | | | | O | | | | | | |
| 10 | | | | | | | | | | | |
| 11 | O | O | O | O | O | | | | | | TWO TIMES |
| 12 | | | | | | | | | | | |
| 13 | O | O | O | O | O | O | | | | | ONE TIME |
| 14 | | | | | | O | O | | | | |
| 15 | O | O | O | O | O | O | O | O | | | |
| 16 | | | | | | O | O | | | | |
| 17 | O | O | O | O | O | O | | | | | |
| 18 | | | | | | | | | | | |
| 19 | O | O | O | O | O | O | O | O | | | TWO TIMES |
| 20 | | | | | | | | | | | |
| 21 | O | O | O | O | | | | | O | | TWO TIMES |
| 22 | O | O | O | | O | | | | | O | |
| 23 | O | O | | O | O | | | | O | | |
| 24 | O | | O | O | O | | | | | O | |
| 25 | | O | O | O | O | | | | O | | |
| 26 | O | O | O | O | O | | | | | O | |
| 27 | O | O | O | O | O | | | | O | O | TWO TIMES |
| 28 | | | | | | | | | | | |
| 29 | | | | | O | O | O | O | | | TWO TIMES |
| 30 | | | | O | O | | | | O | O | |
| 31 | | | O | O | O | O | O | O | | | |
| 32 | | O | O | O | O | | | | O | O | |
| 33 | O | O | O | O | O | O | O | O | | | |
| 34 | | O | O | O | O | | | | O | O | |
| 35 | | | O | O | O | O | O | O | | | |
| 36 | | | | O | O | | | | O | O | |
| 37 | | | | | O | O | O | O | | | |
| 38 | | | | | | | | | O | O | |

VACUUM CLEANER

BACKGROUND OF THE INVENTION (1) Field of the Invention

The present invention relates to a vacuum cleaner and, more particularly, to a vacuum cleaner capable of indicating a state of a dust chamber in the body of the vacuum cleaner.

(2) Description of the Prior Art

Conventionally, a vacuum cleaner having a dust chamber in its body is provided with a pressure sensor to detect a suction pressure within the body, and an indicator which indicates the suction pressure to inform a viewer of the state of dust clogging with the dust chamber in the body of the vacuum cleaner (e.g., refer to Japanese Unexamined Patent Publication No. 1136/1981).

In recent years, some vacuum cleaners have arrangements to vary a suction force corresponding to the object being cleaned, such as a carpet, a bare floor, a sofa or a curtain, so as to facilitate cleaning.

However, if such a vacuum cleaner capable of varying a suction force is provided with a pressure sensor in its body to determine the accumulated state of dust in a dust chamber from a detected pressure, the detected pressure is varied in response to the same condition of dust in the dust chamber as the suction force of the cleaner's air blower is varied, and a problem arises that there is no way to accurately inform a user of the state of dust in the dust chamber.

SUMMARY OF THE INVENTION

A vacuum cleaner according to the present invention comprises a cleaner body provided with an air inlet and an air outlet. A dust chamber is provided in the cleaner body communicating with the air inlet and a housing is provided in the cleaner body, communicating with the dust chamber and the air outlet and accommodates an electric air blower. Regulation means are provided for regulating a suction force of the electric air blower which include a pressure sensor provided on the suction side of the electric air blower, comparing means for comparing an output of a detected pressure from the pressure sensor with a reference value, varying means for varying the reference value in proportion to the suction force regulated by the regulation means, and indication means for indicating an accumulated state of dust in the dust chamber based upon the comparison result from the comparing means.

The vacuum cleaner according to the present invention can accurately indicate an accumulated state of dust in the dust chamber even when a suction force of the electric air blower is adjusted correspondingly to cleaning object, such as a carpet, a bare floor, a sofa or a curtain. In the vacuum cleaner according to the present invention, when the pressure difference between the suction pressure within the cleaner body and the ambient pressure is increased over a reference pressure value, a state of dust in the dust chamber is judged that the chamber should be emptied and indicated with indication means. Additionally, in this vacuum cleaner, when the suction force of the electric air blower is increased corresponding to the cleaned object, the reference value is increased so that increase in the suction pressure within the cleaner body is not judged as an indication of the state of dust in the dust chamber as being more full than it really is.

The adjusting means for adjusting the suction force of the electric air blower may be any means for varying an air flow-pressure loss characteristic of the electric air blower. Desirably, the adjusting means may vary the rotating speed of the electric air blower. The adjusting means for varying the rotating speed of the electric air blower may include instruction means for automatically providing instructions about the suction force corresponding to the cleaned object and a control circuit receiving an output from the instruction means, for controlling a voltage applied to the electric air blower. It also may include an identifying circuit for automatically identifying the cleaner load, or a cleaned object, from the pressure in the suction side of the electric air blower by running the electric air blower in advance at a low speed and a control circuit for controlling a voltage applied to the electric air blower in accordance with the identification by the identifying circuit.

BRIEF DESCRIPTION OF THE DRAWINGS

All the accompanying drawings are related to an embodiment of a vacuum cleaner according to the present invention, wherein:

FIG. 6 is a diagram of light emitting diode indication table in an indication mode;

DESCRIPTION OF THE PREFERRED EMBODIMENTS

Figure 1:
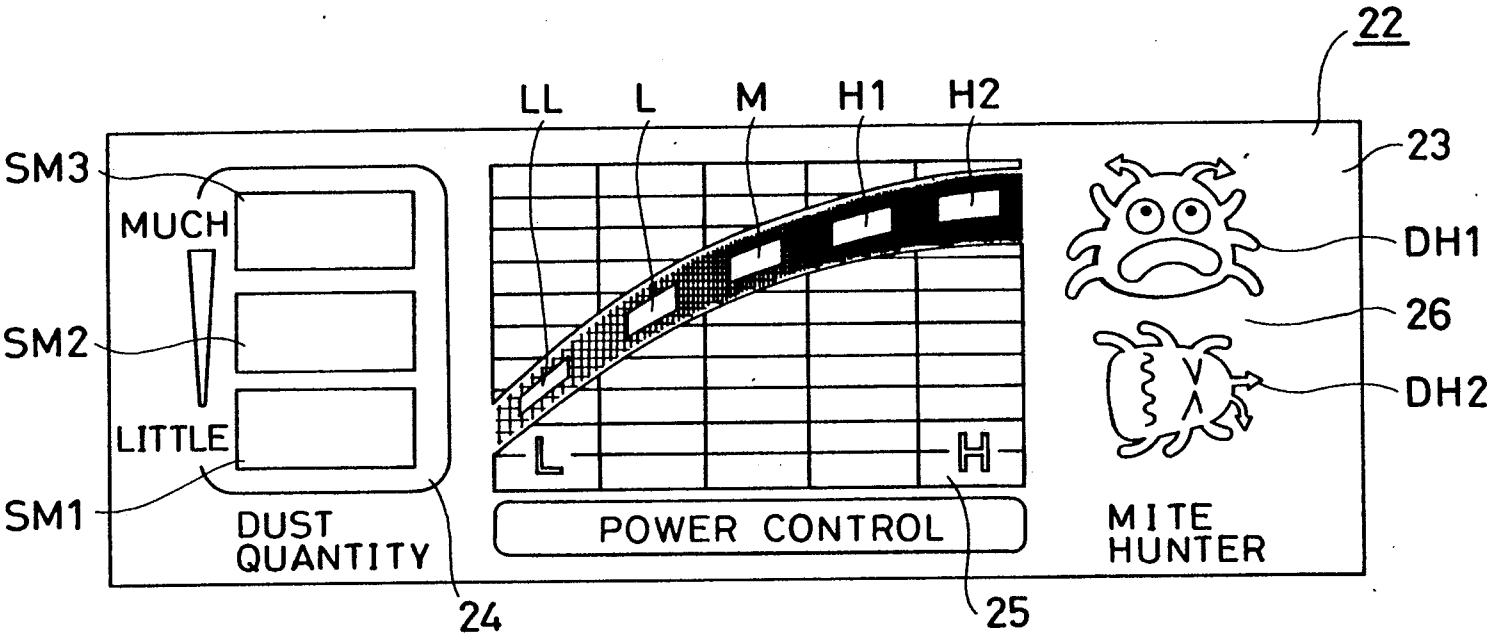
FIG. 1 is an enlarged plan view of a function indication unit.

Now an embodiment of a vacuum cleaner according to the present invention will be explained in conjunction with FIGS. 1 to 18.

Referring to FIGS. 1 to 5, the vacuum cleaner 1 according to the present invention includes a dust chamber 3 in the front part and an air blower housing 6 in the rear part. The dust chamber 3 has an upper aperture removably covered with a cover 2, and the air blower housing 6 communicates with the dust chamber through an air opening 4 and is provided with an air discharging aperture 5 in its rear wall.

An electric air blower 7 is housed in the air blower housing 6 and hermetically communicates in its suction side with the dust chamber 3. An air-permeable box-shaped filter 8 is removably housed in the dust chamber 3. A filter 9 formed of a paper bag having air permeability, but not permitting passage of small noxious organisms such as mites therethrough, is removably housed in the box-shaped filter 8. Also, an air suction filter 10 and an air discharge filter 11 are mounted in the cleaner body 1.

The cover 2 is formed with an air inlet portion 12 and a suction hose (not shown) is rotatably connected thereto. The air inlet portion 12 has an air inlet 13, and comprises a hose socket 14 and a plate 15 positioned above the hose socket 14 and serving as a slidable opening and closing shutter for the air inlet 13.

The cleaner body 1 is further provided with an air channel 16 through which the air discharged from the electric air blower 7 circulates through the dust chamber 3 to heat up the dust chamber 3 to a temperature high enough to kill small noxious organisms, such as mites, caught in the filter 9. The air channel 16 includes a body air channel 18 and a cover air channel 20. The body air channel 18 has its air inlet at the air blower housing 6 and the cover air channel 20 has its air outlet 19 at the hose socket 14 of the air inlet portion 12. When the suction hose is attached to the suction opening portion 12 in the cleaning operation, the air outlet 19 is blocked so as not to pass the air discharged from the air blower 7, and when the suction hose is detached during the mite killing operation, it conducts the discharged air.

Figure 2:
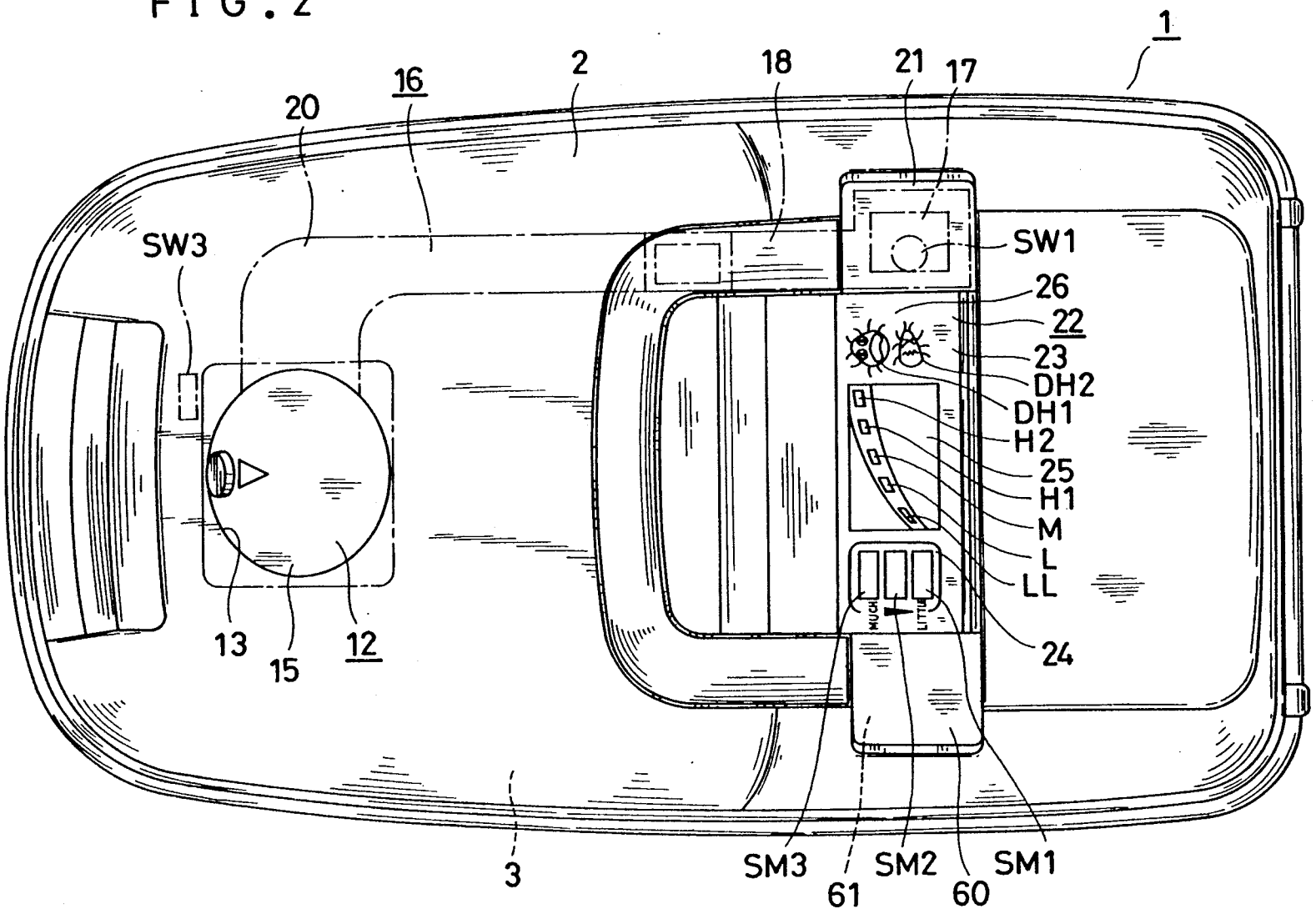
FIG. 2 is a top plan view of the vacuum cleaner.
Figure 3:
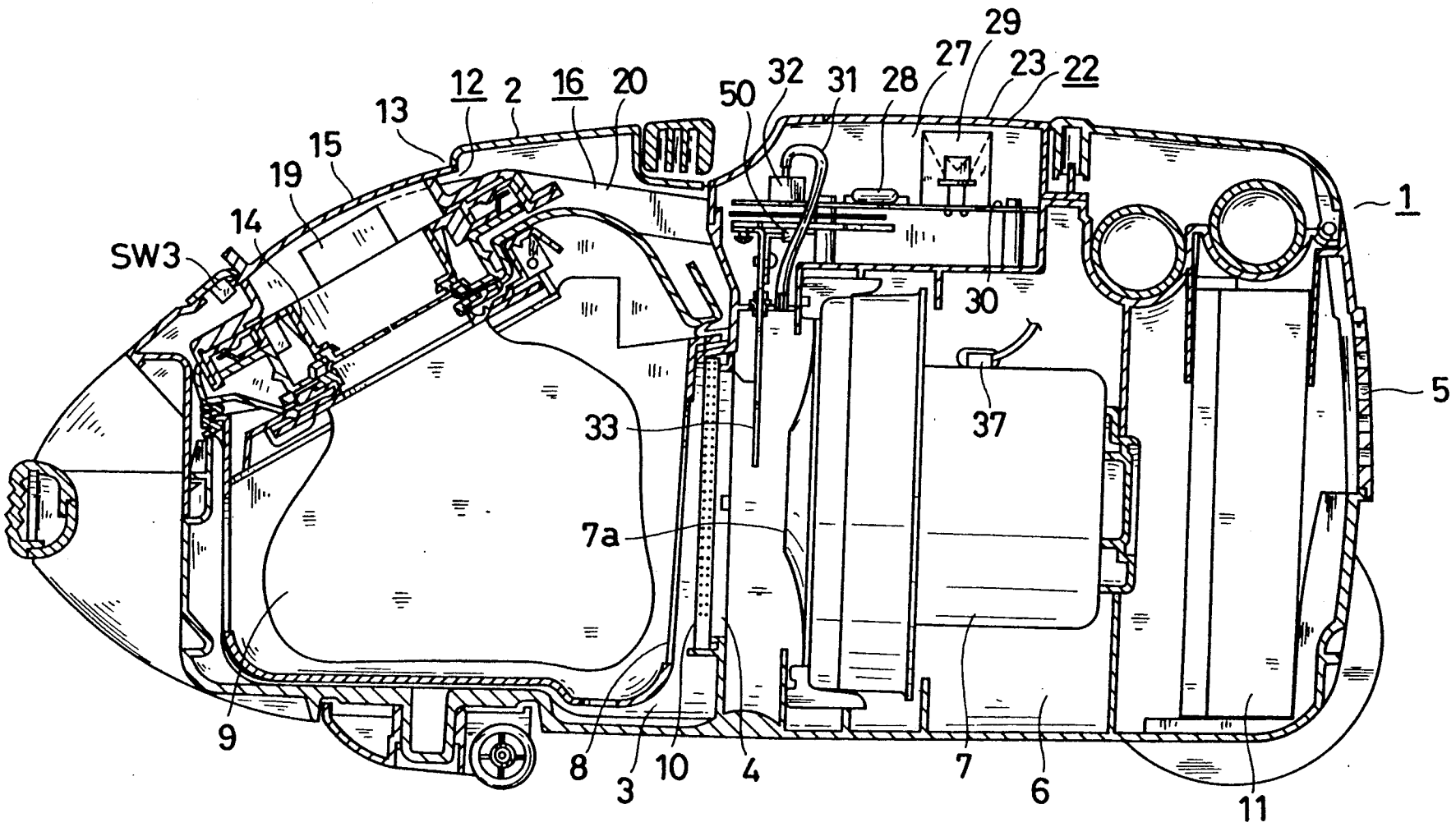
FIG. 3 is a sectional view of the vacuum cleaner.
Figure 4:
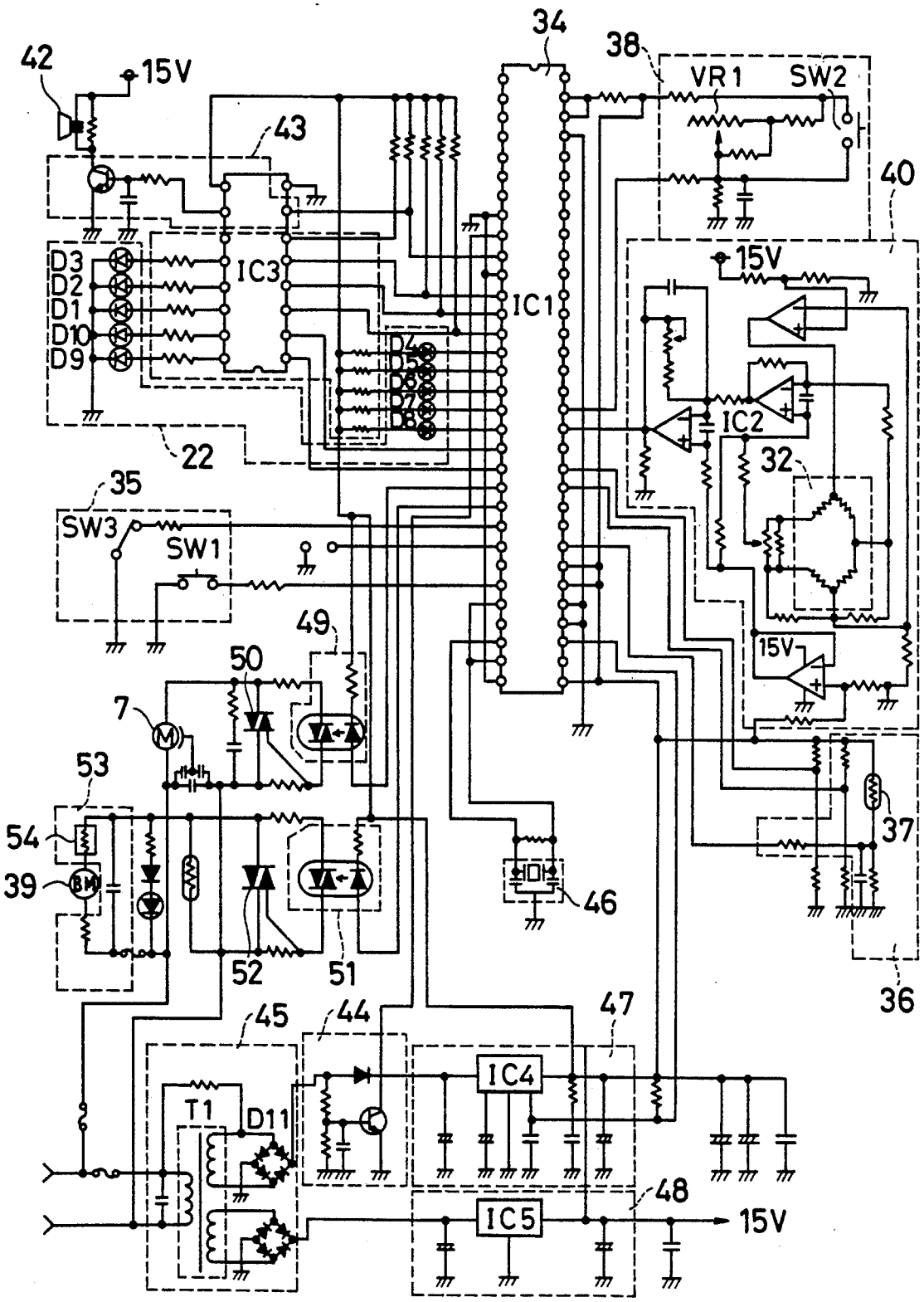
FIG. 4 is a circuit diagram of the control circuit.
Figure 5:
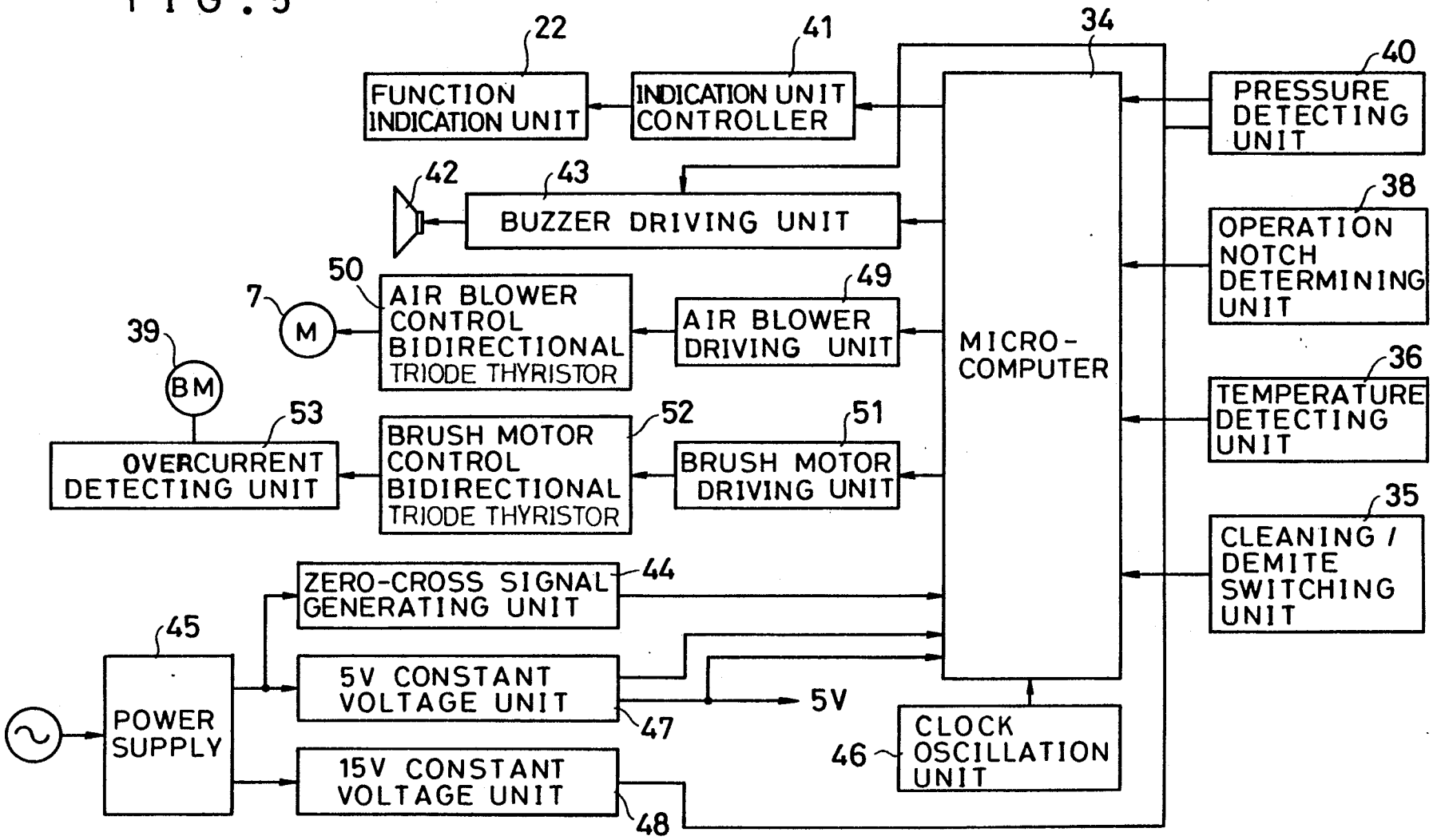
FIG. 5 is a block diagram of the control circuit.

A mite killing operation switch button 21 is provided on the right in the center portion of the upper face of the cleaner body 1 (see FIG. 2). A mite killing operation switch SW1, which is a tactile switch, is inside the mite killing operation switch button 21 to turn on by depressing the mite killing operation switch button 21.

A shutter switch SW3 is provided in the air inlet portion 12. The shutter switch SW3 is turned off by the shutter plate 15 coming in contact with it when the shutter plate 15 is closed, and turned on when the shutter plate 15 is opened.

A function indication unit 22 is provided in the center portion of the upper face of the cleaner body 1. The function indication unit 22 illuminates an indication panel 23 with light from light emitting diodes positioned at its rear. Namely, each function is indicated by the energization of each of the light emitting diodes. The indication unit 22, as shown in FIG. 1, includes a dust quantity meter 24, a power control indicator 25 and a mite killing indicator 26. The dust meter 24 indicates five levels of dust volume in the filter 9 with illumination of different combinations of three light emitting diodes (LEDs), D1 to D3. The dust volume can be recognized at a sight by illumination of a green marker SM1 corresponding to the light emitting diode D1, an orange marker SM2 corresponding to the light emitting diode D2 and a red marker SM3 corresponding to the light emitting diode D3 in the order of volume, small to large. When the filter 9 should be replaced with a new one, the green, orange and red marker SM1, SM2 and SM3 intermittently light up to inform a user of the time of replacement. Specifically, the dust volume is indicated by all of D1, D2 and D3 being off, lighting up one light emitting diode (D1), lighting up two light emitting diodes (D1 and D2), lighting up three light emitting diodes (D1, D2 and D3) and lighting up and turning off three light emitting diodes (D1, D2 and D3), in the order of volume, small to large.

The power control indicator 25 indicates the suction force of the electric air blower 7, namely, a state of output control, with a notch indicator of five levels, LL, L, M, H1 and H2, corresponding to five red light emitting diodes D4 to D8, respectively.

The mite killing indicator 26 indicates a state of mite killing operation by illuminating first and second markers DH1 and DH2 with a green light emitting diode D9 and a red light emitting diode D10, respectively: Lighting up the first marker DH1 represents mites are alive, and lighting up the second marker DH2 represents that the mites are killed. The indicator 26 shows the effect of the mite killing operation by variations of lighting up the first marker DH1, alternately lighting up and turning off the first and second markers DH1, DH2 and lighting up the second marker DH2 in accord with a temperature increase within the dust chamber during the mite killing operation.

A control board housing unit 27 is mounted in the upper portion of the air blower housing 6 in the cleaner body 1. The top face of the control board housing unit 27 is covered with the cleaner body panel 23 and the unit 27 accommodates a control circuit board 30 provided with the light emitting diodes D1 to D10 and a reflection plate 29. Further, the control circuit board 30 carries an air blower control bidirectional triode thyristor 50 having a heat sink plate 33 positioned in the space at the blower suction side *7a*. A semiconductor pressure sensor 32 communicates with the space at the suction side *7a* of the electric air blower through a tube 31, for determining a pressure at the suction side *7a*. For the sensor 32, a diffusion type semiconductor pressure sensor (e.g., a FPN-07PGR type semiconductor pressure sensor manufactured by FUJIKURA Ltd.) which operates on a piezoresistance effect is used.

A microcomputer microprocessor 34 is used (see FIG. 3) which is a single chip including an operation processing unit, a input/output unit, a memory, etc. The microprocessor 34 stores each program of the cleaning mode, mite killing mode and the indication mode.

A cleaning/demite switching unit 35 has the mite killing operation switch SW1 and the shutter switch SW3.

A temperature detecting unit 36 employs a thermistor element 37 as a temperature detecting means. Supply voltage from a DC5V constant voltage unit 47 is regulated by the thermistor element 37 and the regulated voltage is applied as a temperature detecting output to the microcomputer 34. The thermistor element 37 is placed on the electric air blower, electrically isolated therefrom, to detect a temperature in a bracket of the electric air blower 7 and indirectly detects the temperature in the circulating air discharged from the electric air blower 7. In this way, the thermistor element 37 detects a temperature for stopping the mite killing operation while it detects an abnormal temperature in the electric air blower.

Figure 18:
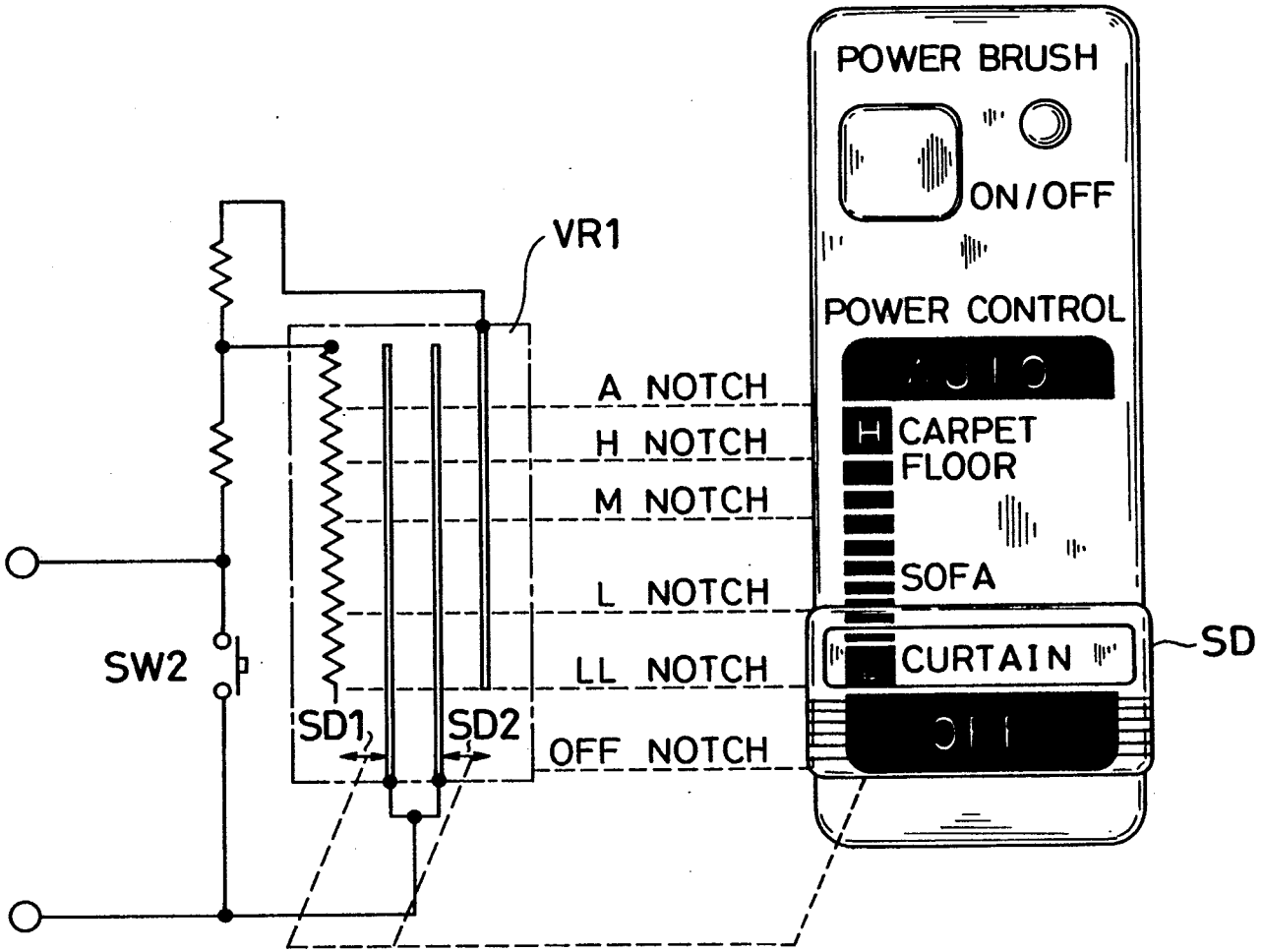
FIG. 18 is a diagram presented for explaining relations between a function board on a grip of a suction hose and an electric circuit.

An operation notch determining unit 38 is positioned in a function board (FIG. 18) on a grip of the suction hose connected to the cleaner body 1 and includes a suction force control rheostat VR1, for controlling the suction force of the electric air blower 7, and a brush switch SW2 for turning on and off a motor 39 driving a rotation brush of a floor nozzle (not shown). The suction force control rheostat VR1 varies the suction force of the electric air blower 7 by varying a signal voltage inputted to the microcomputer depending upon a position of each of sliding elements SD1, which are manually moved with a control knob SD. As shown in FIG. 18, the suction force control rheostat VR1 inputs to the microcomputer 34 a signal voltage corresponding to each of a stop position (OFF notch), a carpet position corresponding to a "high" suction force (H notch), a floor/tatami-mat position corresponding to an "intermediate" suction force (M notch), a sofa position corresponding to a "low" suction force (L notch), a curtain position corresponding to the "lowest" suction force (LL notch) and an auto position for automatic control (A notch). The brush switch SW2 turns on and off the motor 39 for the rotation brush when the suction force control rheostat VR1 is set at a notch other than the OFF notch.

A pressure detecting unit 40 uses the semiconductor pressure sensor 32 for detecting variations in pressure (negative pressure) in a space between the suction side 7*a* of the electric air blower 7 and the suction filter 4. The semiconductor pressure sensor 32 is a piezoresistance bridge circuit, and a constant current is supplied to the bridge from a constant current circuit including an operational amplifier. Unbalanced voltage of the bridge, which is caused by a change in pressure, is amplified by an differential amplifier IC2 made of an operational amplifier and is further inverted and amplified. Accordingly, a detected output voltage of the semiconductor pressure sensor 32, which is inputted to the microcomputer 34, is about 4.8 V when the change in pressure is 0, and is reduced to 0 as the change in pressure (negative pressure) becomes larger. In other words, the change in pressure is inversely proportional to the detected output voltage.

Reference numeral 41 denotes an indication unit controller. The light emitting diodes D4 to D8 of the power control indicator 25 work in response to the signal voltage from the operation notch determining unit 38. All the diodes are of (no light) when the OFF notch is set, one of them lights up for the LL notch, two of them light up at the L notch, and three of them light up at the M notch, five of them light up at the H notch. The diodes light up by the number corresponding to the detected output voltage from the pressure detecting unit 40 when the A notch is set.

A buzzer 42 is controlled by a buzzer control unit 43. The buzzer 42 sounds when the notch is reset, when the temperature detecting unit 36 senses an abnormal heating, when three of the light emitting diodes D1 to D3 in the dust meter 24 light up and out and when the mite killing operation switch SW1 is depressed.

A zero-cross signal generating unit 44 transforms an alternating voltage stepped down at a power source transformer T1 into a full wave type voltage at a bridge diode D11, modifies a waveform of the voltage at a transistor, and generates a pulse signal at a zero-cross point in each half cycle of the alternating voltage.

Reference numerals 46, 47 and 48 denote a clock oscillation unit, a 5 V constant voltage unit having a resetting unit for the microprocessor, and a 15 V constant voltage unit, respectively.

Reference numerals 49 and 50 denote a gate signal transmitting unit and an air blower control bidirectional triode thyristor, respectively.

Further, reference numerals 51 and 52 denote a gate signal transmitting unit for the motor 39 driving the rotation brush of the floor nozzle, and a rotation brush driving motor control bidirectional triode thyristor.

An overcurrent detecting unit 53 for the floor nozzle has a positive temperature characteristic thermistor 54 which restricts current to stop supplying electric power to the brush motor 39 when the motor 39 is locked because the rotation brush is tangled with a piece of cloth or the like.

The microcomputer 34 turns to the cleaning mode when the shutter switch SW3 is on. In the cleaning mode, the electric air blower 7 changes its suction force corresponding to the notch set by the suction force control rheostat VR1 of the operation notch determining unit 38, and the brush motor turns on and off in accordance with ON/OFF of the brush switch SW2.

The microcomputer 34 receives an output of the detected temperature from the temperature detecting unit 36. When it is detected that the electric air blower 7 is excessively heated and its bracket temperature is over 100° C., all the functions are turned off to stop supplying electric power to the electric air blower 7.

The microcomputer 34 turns to the mite killing mode when the shutter switch SW3 is off. In the mite killing mode, as the mite killing operation switch SW1 is turned on, the electric air blower 7 runs. When the temperature detecting unit 36 detects that the dust chamber 3 is heated up to 50° C., which is high enough to kill the noxious small organisms such as mites, namely, when the temperature of the bracket of the electric air blower 7 is 70° C. (at which the mite killing operation is stopped) or over, the electric air blower 7 stops. In the mite killing mode, the mite killing indicator 26 is: lit up with the green light emitting diode D9 for 10 seconds after the electric air blower 7 starts to run; thereafter lit up alternately with the green light emitting diode D9 and the red light emitting diode D10; and further lit up with the red light emitting diode D10 when the temperature of the bracket of the electric air blower 7 reaches 70° C.

Further, the microcomputer 34 turns to the indication mode by continuing to depress the mite killing operation switch button 21 for two seconds or more after the power cord plug of the cleaner is inserted into a receptacle for commercial electric power supply while the mite killing operation switch button 21 is being depressed, or by continuing to depress the mite killing operation switch button 21 for two seconds or more two seconds or less after the plug is inserted into the receptacle in the condition that the shutter switch SW3 is off, namely, in the mite killing mode.

In the indication mode, the microcomputer 34 has a function of operating the dust meter 24 and the power control indicator 25 to light up and go off with sixty light emitting patterns in a single cycle according to indicating steps shown in FIG. 6 (a symbol of a circle indicates lighting). Electric power is not supplied to the electric air blower 7 in the indication mode, and the indication mode is released by pulling the plug of the cleaner out of the receptacle.

Now, the operation of switching among the cleaning mode, mite killing mode and indication mode will be described in conjunction with flow charts.

Figure 7:
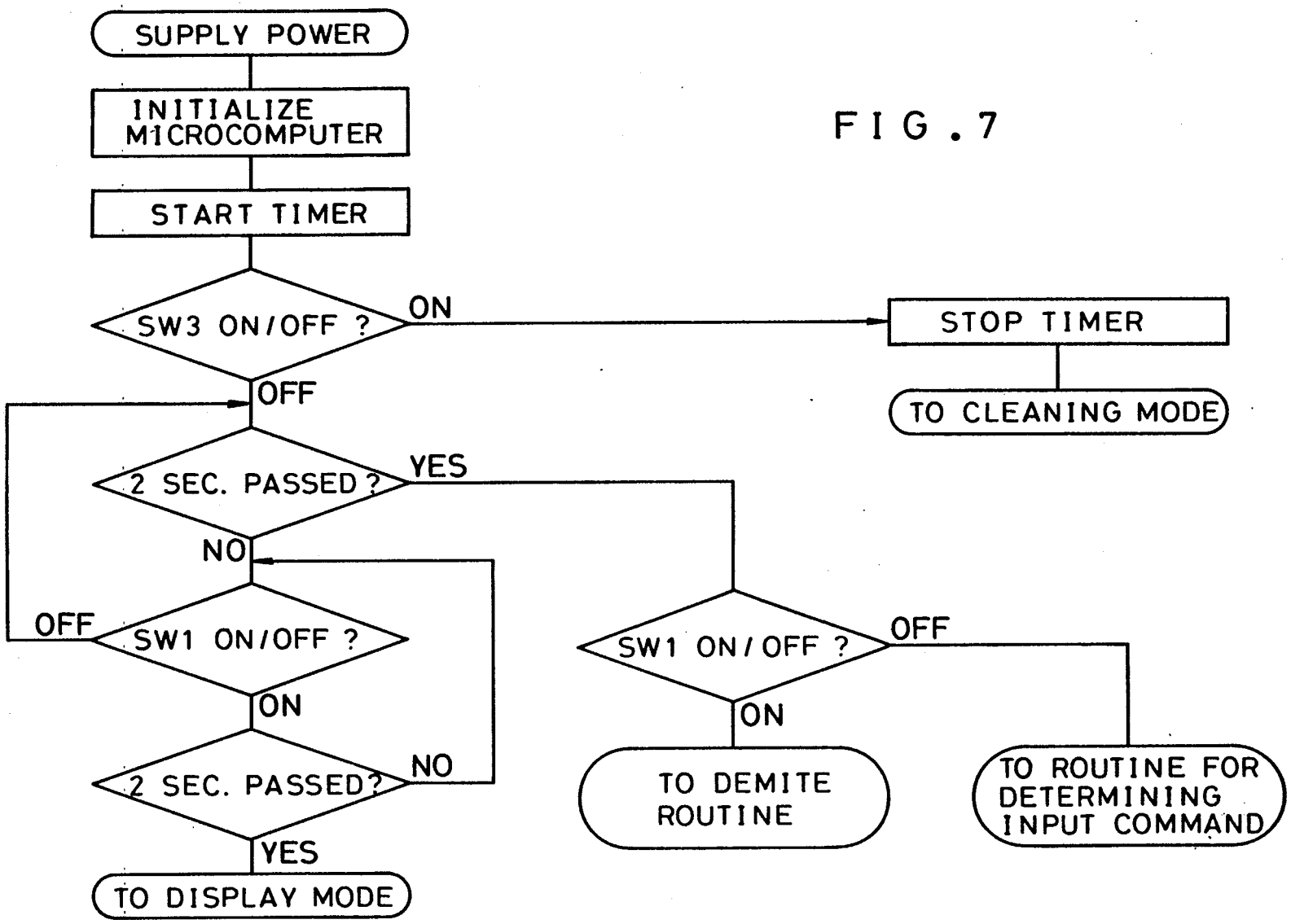
FIG. 7 is a flow chart corresponding to the initial stage of the operation beginning with supplying electric power.

FIG. 7 is a flow chart corresponding to the initial stage of the operation beginning with supplying electric power. When the plug of the cleaner is connected to the receptacle, the microcomputer 34 is initialized. After that, a timer (limiting a time to two seconds) is started to prepare for the indication mode. Then, the state of the shutter switch SW3 is confirmed. When it is on, it is judged that the mite killing mode does not go on, and the timer is stopped and the cleaning mode is carried out. When the shutter switch SW3 is off, it is judged whether or not the timer has counted up two seconds. When the timer has not, it is judged whether or not the mite killing operation switch SW1 continues to be on due to depressing. If the mite killing operation switch SW1 continues to be on for two seconds or more thereafter, the indication mode is carried out. If the mite killing operation switch SW1 comes to be off within two seconds or two seconds has passed after supplying electric power, a state of the mite killing operation switch SW1 is confirmed. When the switch SW1 is on, the mite killing mode is carried out, and when it is off, each of the input determining routines (e.g., a notch determining routine) is carried out.

Figure 8:
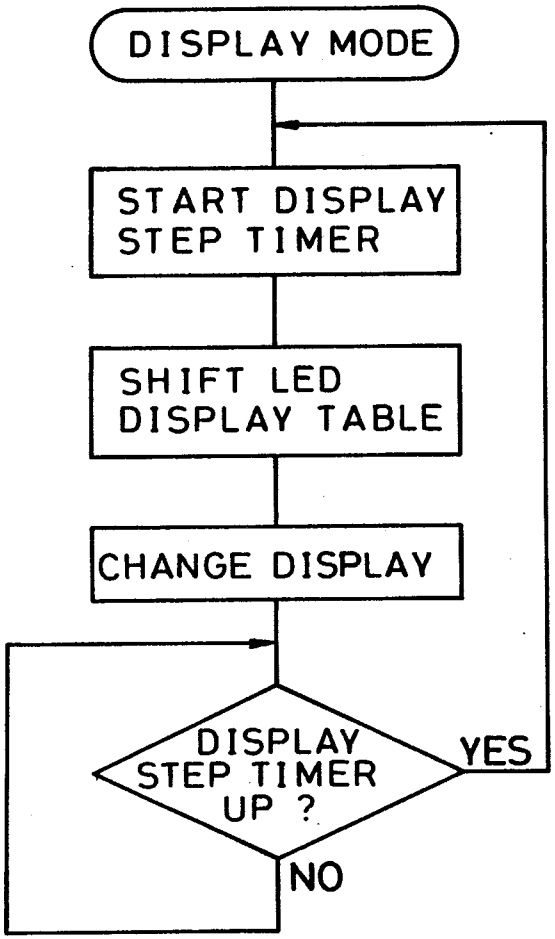
FIG. 8 is a flow chart of the indication mode.
Figure 9:
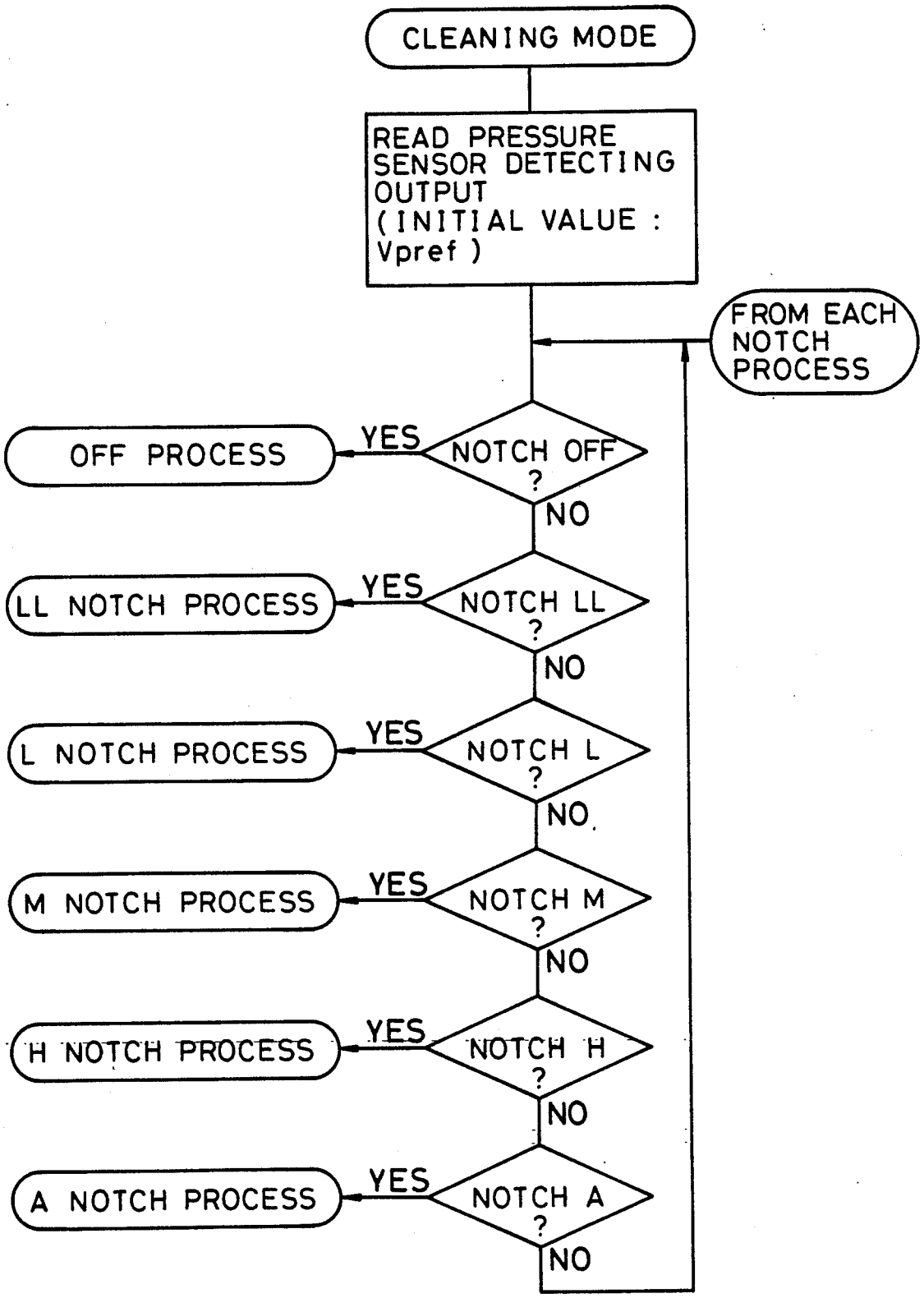
FIG. 9 is a flow chart of a cleaning mode.

FIG. 8 is a flow chart corresponding to the operation of the indication mode, which is an endless loop routine. In the case where the indication mode is carried out, sixty light emitting patters in a single cycle are repeated according to the indicating steps shown in FIG. 6 each time of setting the indicating step timer. This brings out an improved indication effect of the vacuum cleaner in a show window at a shop.

The relations of a detected output voltage from the pressure sensor 32 to the dust meter 24 and the power control indicator 25 are explained in conjunction with flow charts shown in FIGS. 9 to 14.

In the cleaning mode, when the plug of the cleaner has been connected to the receptacle and the electric air blower 7 still stops, the detected output voltage from the pressure sensor 32 is read by the microcomputer 34 and stored in the microcomputer 34 as an initial voltage value $V_{pref}$ for reference.

After that, judments are sequentially performed for signal voltages from the operation notch determining unit 38 to determine on which notch the operation currently is to be performed.

Figure 10:
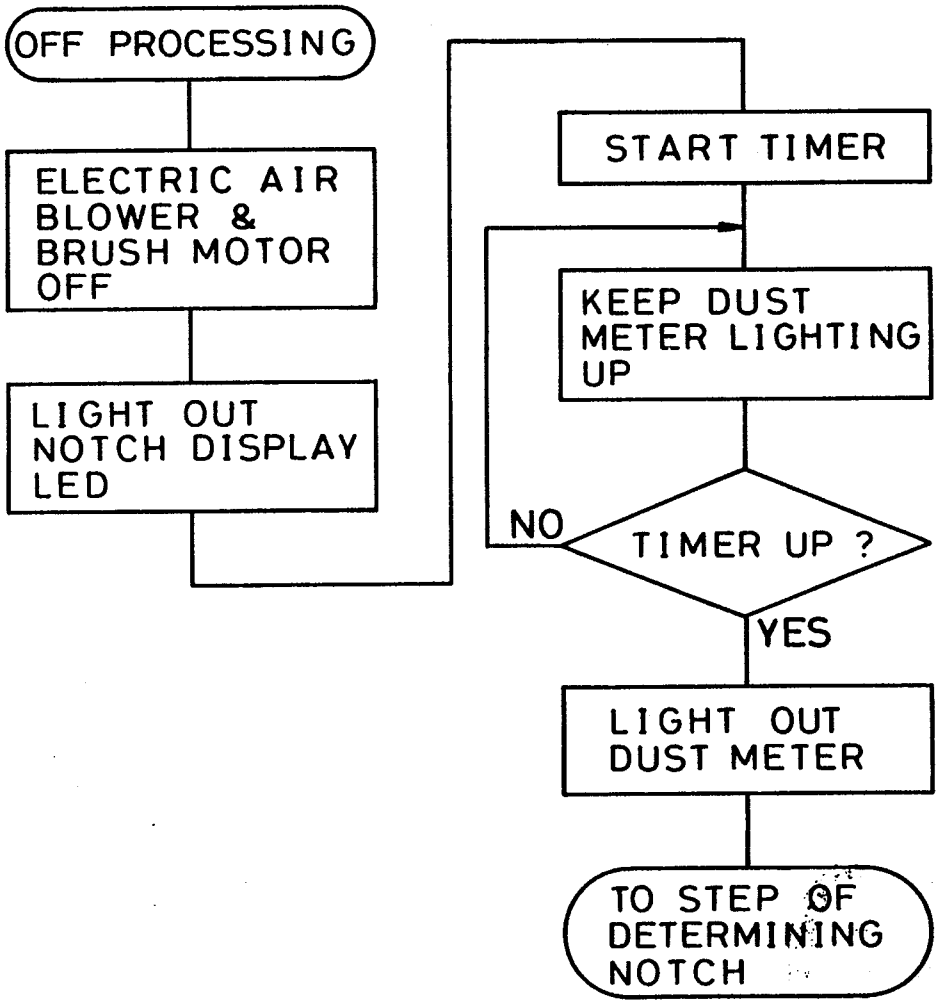
FIG. 10 is a flow chart of an OFF processing.

When the OFF notch is set, an OFF processing routine shown in FIG. 10 is carried out, so that supplying electric power to the electric air blower 7 and the brush motor 39 is stopped, and the notch indicating light emitting diodes D4 to D8 are off. Then, a timer is started for keeping the dust volume indicated for a certain period of time after the determination of the OFF notch. When the timer has counted up a specified time, the dust meter puts the lights fully off, and the notch determining routine is carried out again.

Figure 11:
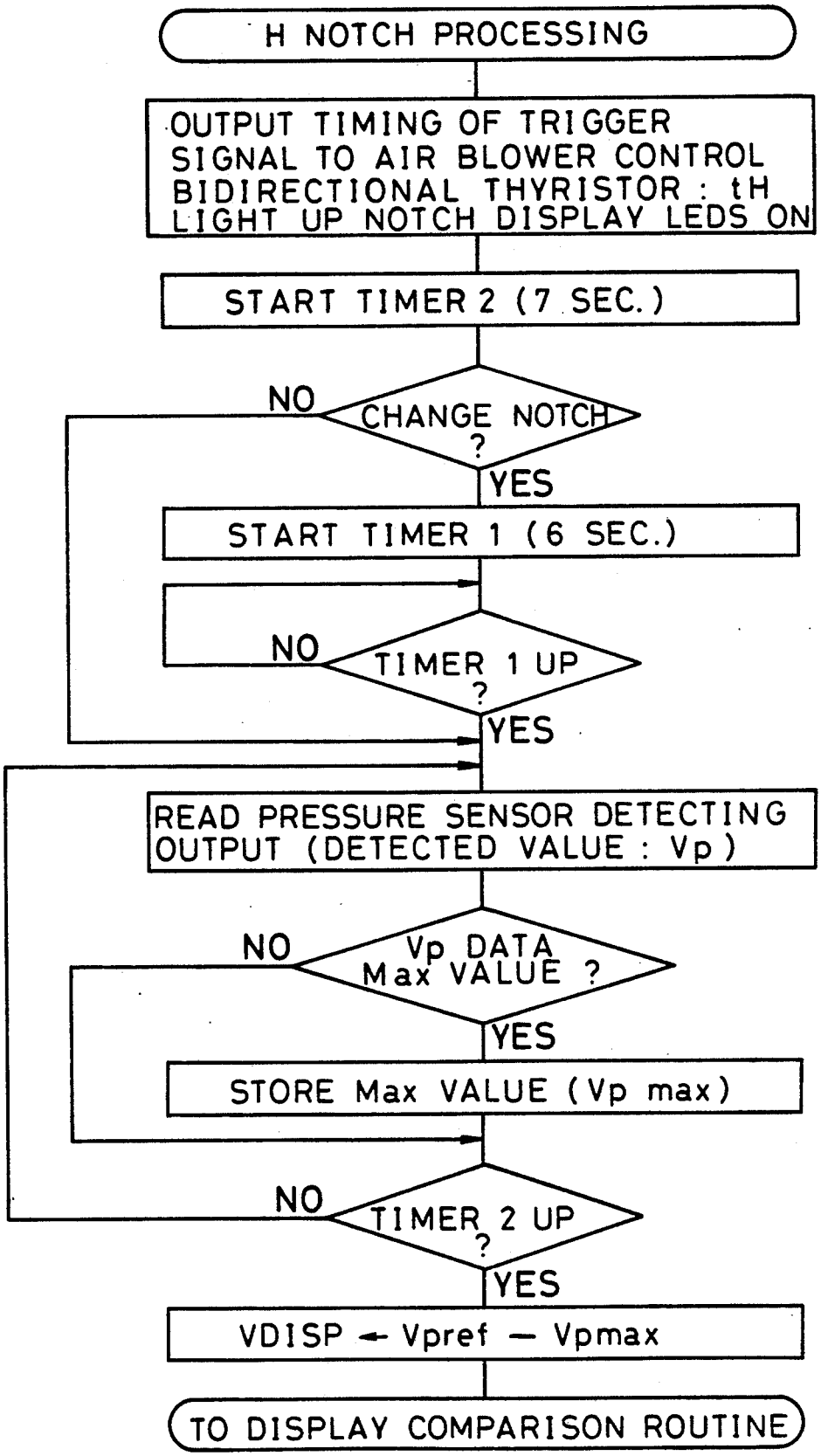
FIG. 11 is a flow chart of an H notch processing.

When the H notch is set, an H notch processing routine shown in FIG. 11 is carried out. First, a trigger signal is inputted to the air blower control bidirectional triode thyristor 50 at a timing of $t_H$ shown in FIG. 15 to drive the electric air blower 7, so that the corresponding notch indicating light emitting diodes light up (the diodes D4 to D8 in the case of the H notch). Then, a timer 1 (6 sec timer) and a timer 2 (7 sec timer) are started. The timer 1 is used for avoiding an effect of pressure variation when a rotating speed of the electric air blower is changed in varying the notch, and the timer 2 is used for renewing the indication of dust volume. Until the timer 1 ends timing, pressure is not detected; in other words, a pressure detection is started just when the timer 1 ends timing. Detected pressure is read at a timing of a zero-cross signal, and a value larger than values in the past alone is stored. After the timer 2 ends timing, a difference between the reference value $V_{pref}$ stored after the initialization of the microcomputer 34 and a maximum data value $V_{pmax}$ is calculated, and the obtained value would be VDISP.

Figure 12:
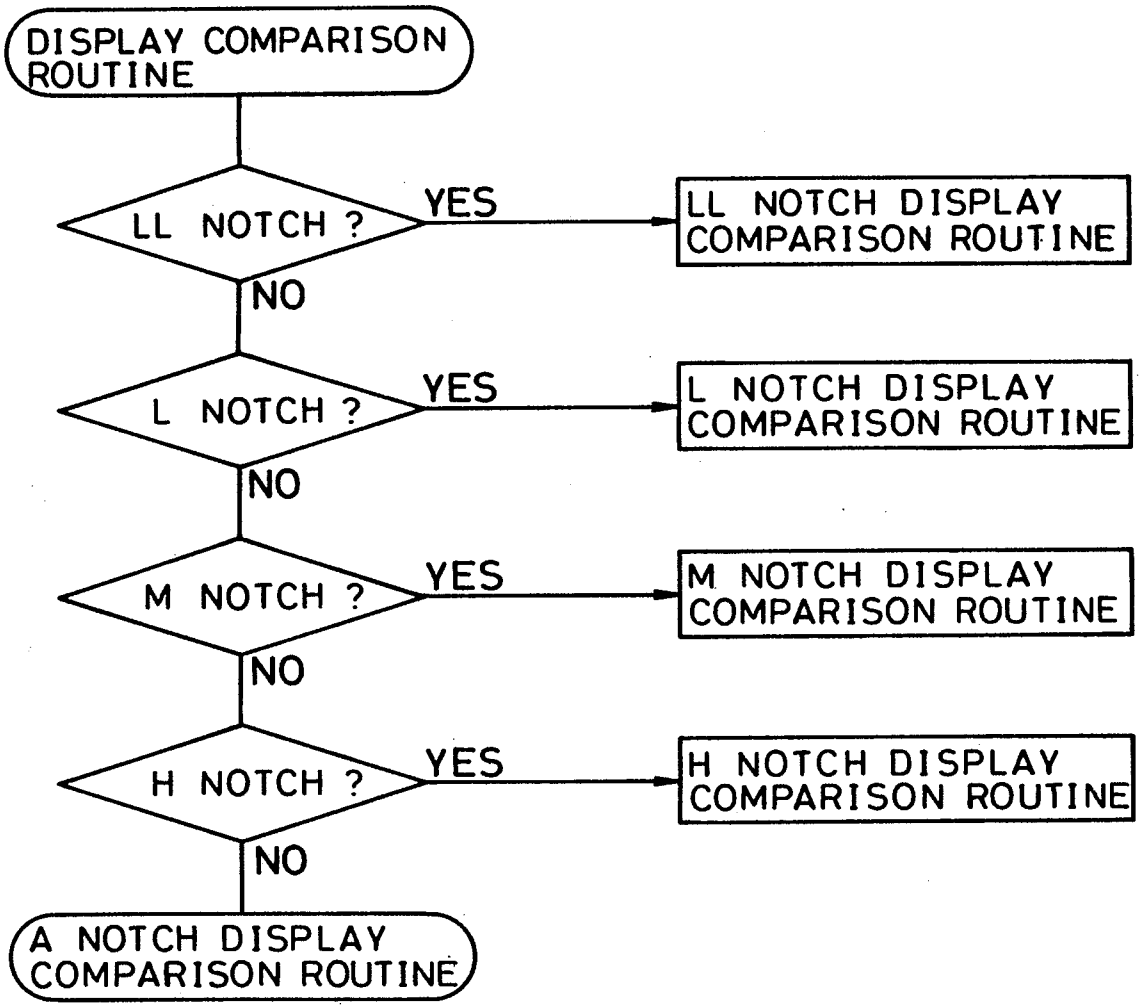
FIG. 12 is a flow chart of an indication comparison routine.

Then, an indication comparison routine shown in FIG. 12 is carried out.

The cases where the M notch, L notch or LL notch are set are similar to the case where the H notch is set, and therefore the explanation is omitted. They are different from the H notch in an output timing of a trigger signal (a trigger timing is: $t_H$ for the H notch, $t_M$ for the M notch, $t_L$ for the L notch and $t_{LL}$ for the LL notch) and the number of notch indicating light emitting diodes which light up.

Figure 13:
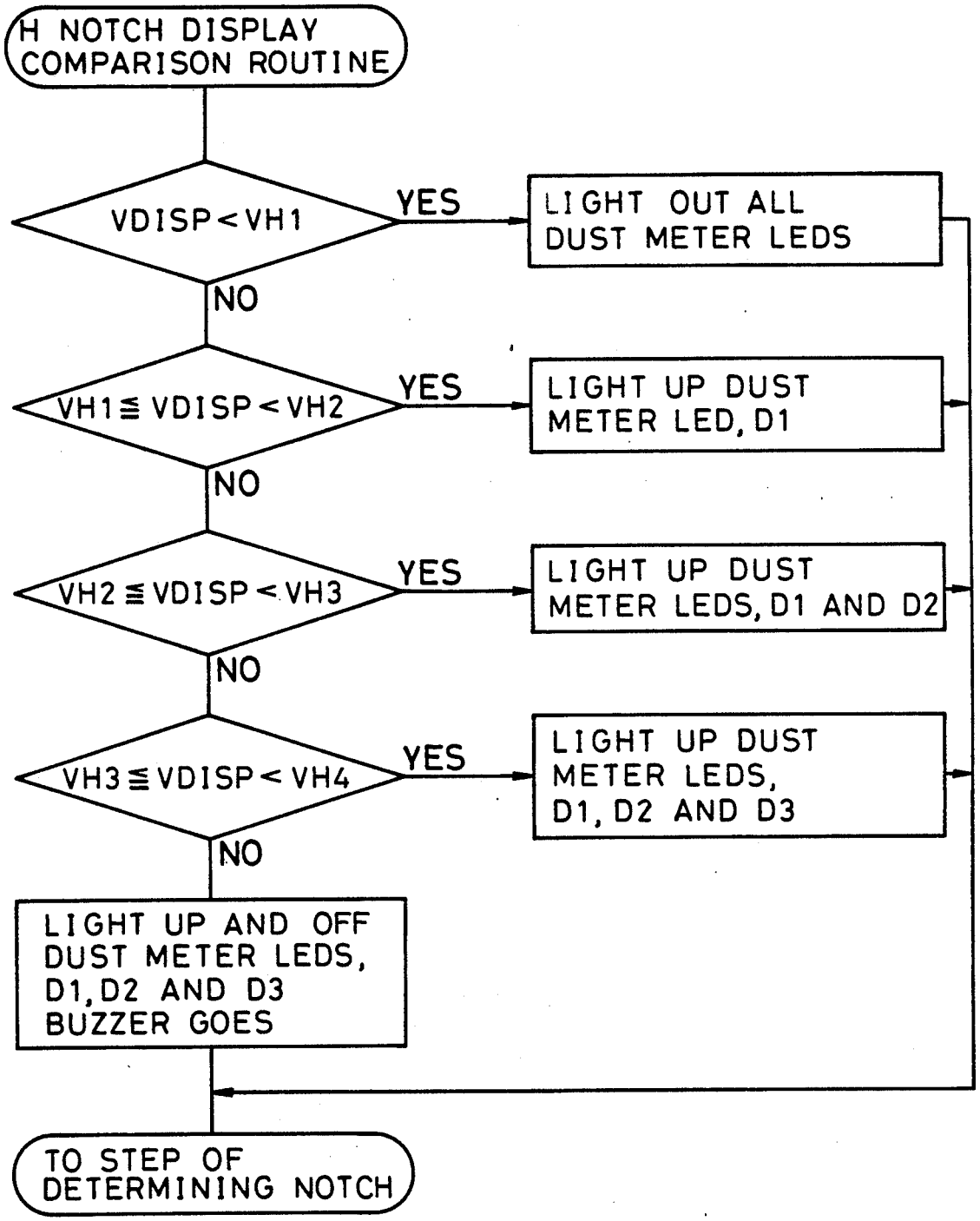
FIG. 13 is a flow chart of an H notch indication comparison routine.

In the indication comparison routine, it is judged which notch is the one set. If it the H notch, an H notch indication comparison routine shown in FIG. 13 is carried out. In the H notch indication comparison routine, a difference voltage VDISP is compared with reference voltages VH1, VH2, VH3, and VH4, i.e., respective dust volume indication levels which are experimentally found in the H notch. If $VH2 \leqq VDISP < VH3$ is satisfied, the light emitting diodes D1, D2 in the dust meter 24 light up. Then, the notch determining routine is carried out again.

The respective reference voltages VH1, VH2, VH3, VH4 have relations of $VH1 < VH2 < VH3 < VH4$. Namely, VH1=1.563 (V), VH2=2.265 (V) VH3=2.930 (V), and VH4=3.144 (V). Similar processing is done for the M, L and LL notches, though reference voltages, that is, comparison levels are experimentally found for each of the notches. If those reference voltages are proposed in correspondence with the VH1, VH2, VH3 and VH4:

In the M notch, VM1 (1.250 V)<VM2 (1.836 V)<VM3 (2.305 V)<VM4 (2.500 V),

In the L notch, VL1 (0.996 V)<VL2 (1.484 V)< VL3 (1.895 V)<VL4 (2.070 V), and

In the LL notch, VLL1 (0.684V)<VLL2 (1.035 V)<VLL3 (1.308 V)<VLL4 (1.445 V).

Thus, voltage levels proposed as reference voltages are different in each of the notches.

Figure 14A:
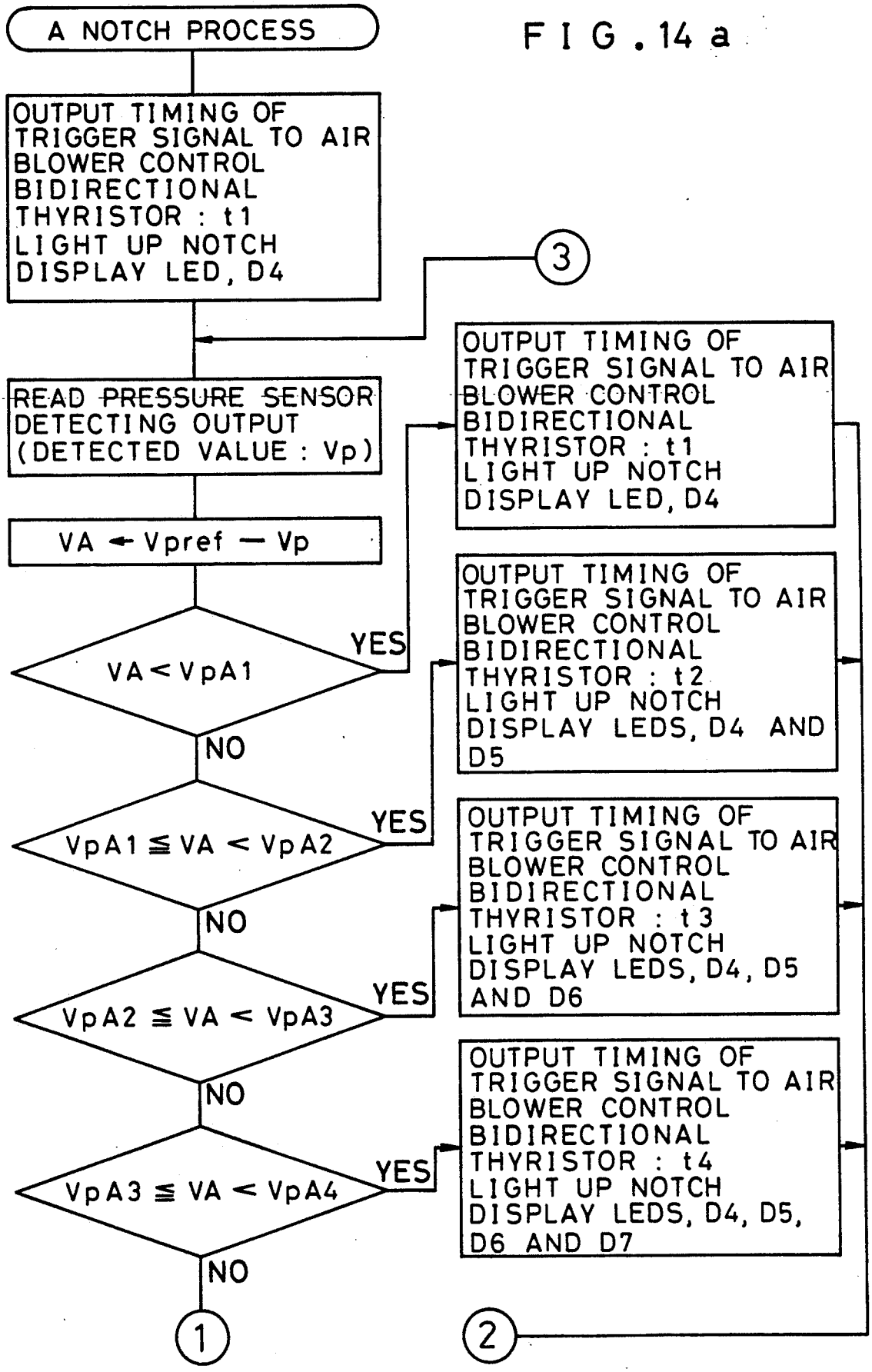
FIGS. 14*a* and 14*b* are flow charts of an A notch processing.
Figure 14B:
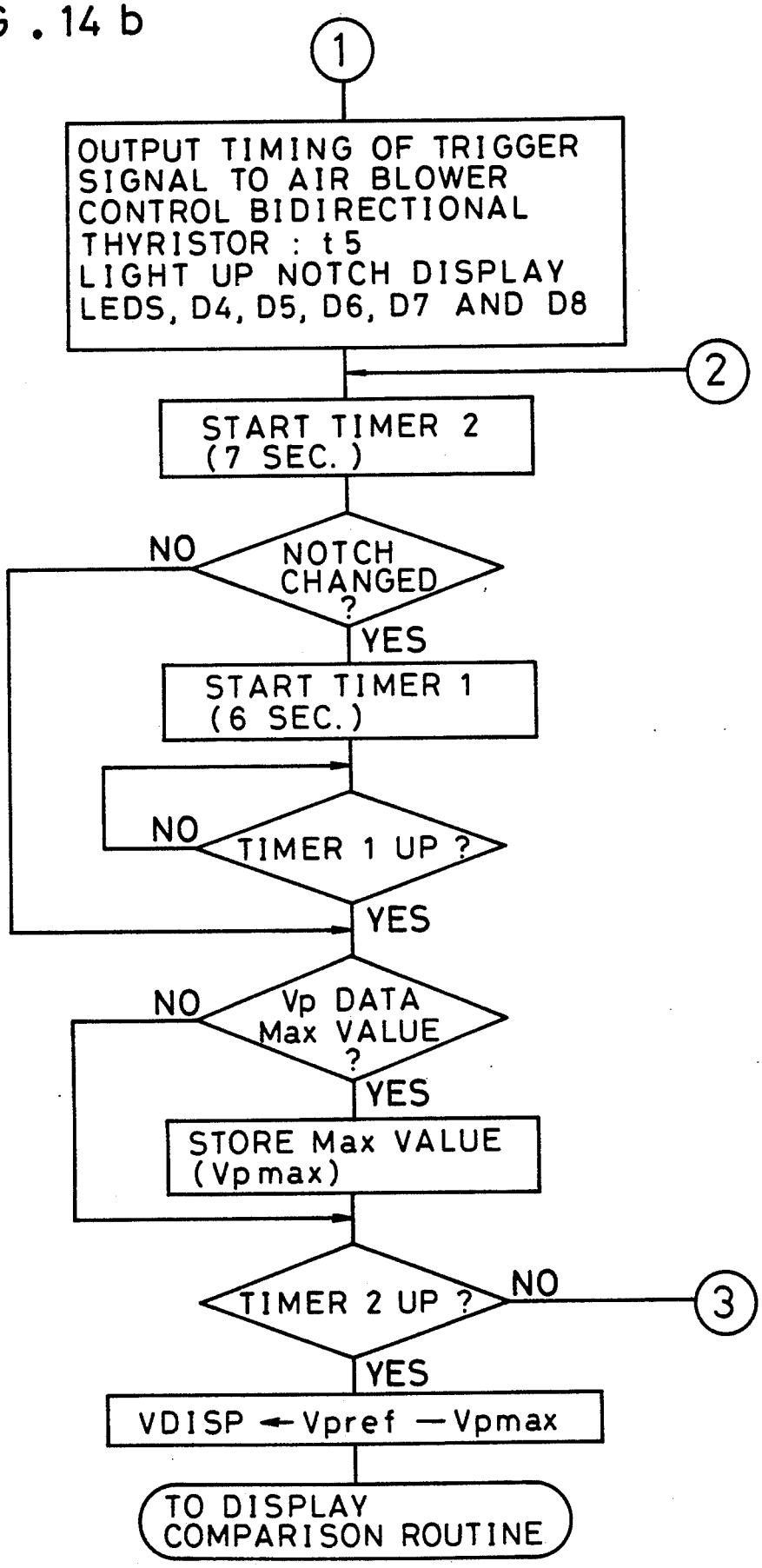
Figure 15:
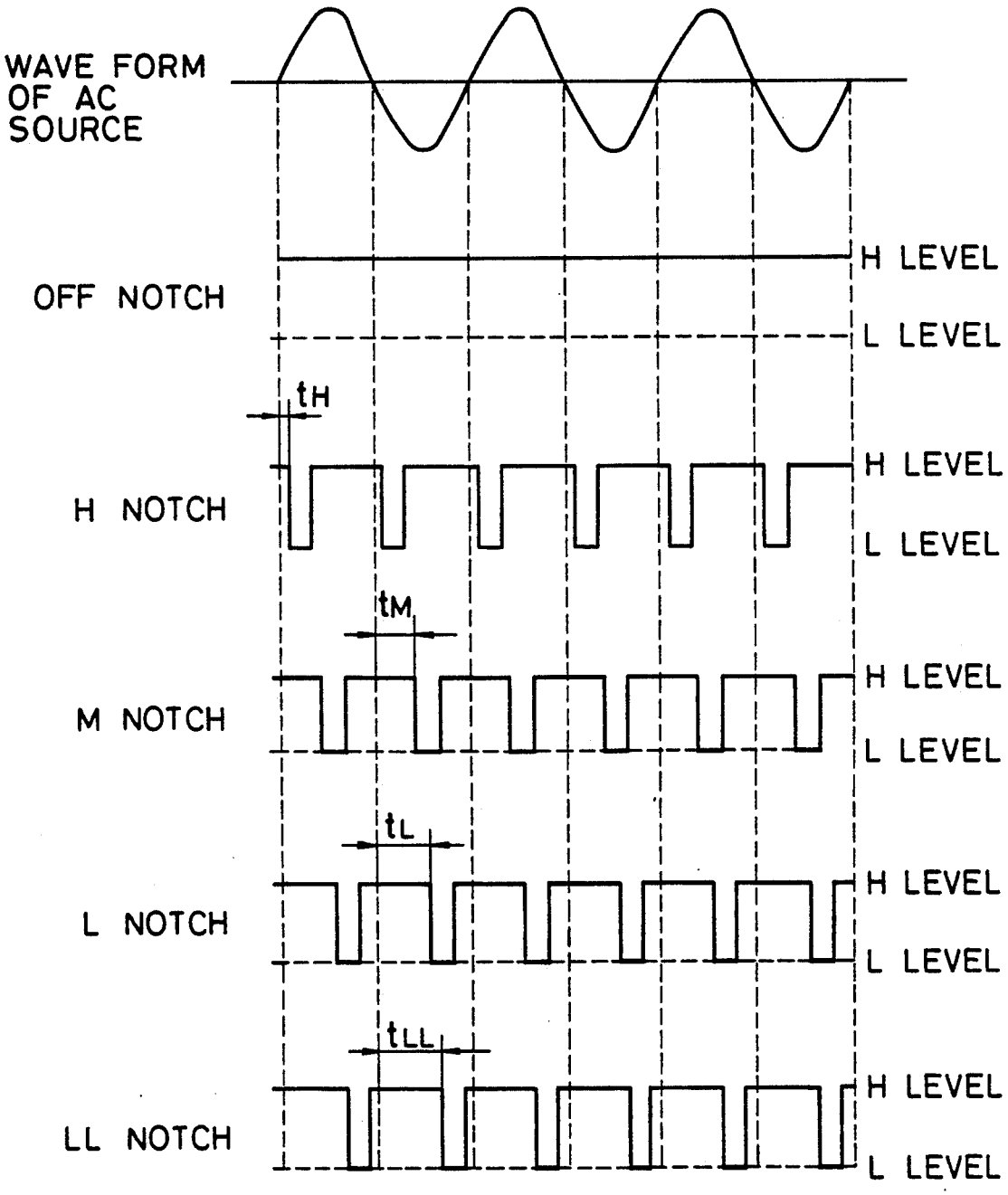
FIG. 15 is a timing diagram of a trigger signal of an air blower control bidirectional triode thyristor under manual control.

When the A notch is set, an A notch processing routine shown in FIGS. 14*a* and 14*b* is carried out. However, a routine for varying a bidirectional triode thyristor trigger timing in response to the detected output from the pressure sensor 32 is added to the A notch processing routine, so that a processing similar to that in setting the H, M, L and LL notches are performed with regard to the dust meter 24.

Now, the variation in the bidirectional triode thyristor trigger timing will be explained with reference to the flow chart. First, when the A notch is set, the trigger signal is outputted at a timing t1, and the electric air blower 7 runs and the notch indicating light emitting diode D4 lights up.

Then, pressure detection is performed, and an output voltage detected at time VP.

Assuming that a difference voltage VA between the reference voltage $V_{pref}$ stored when the computer 34 is initialized and VP is, $$VA = V_{pref} - VP$$

is calculated. The value VA is compared with values VPA1, VPA2, VPA3 and VPA4, which were experimentally found. In the example described VPA1. (1.074 V)<VPA2 (1.309 V)<VPA3 (1.602 V)<VPA4 (2.920

Figure 16:
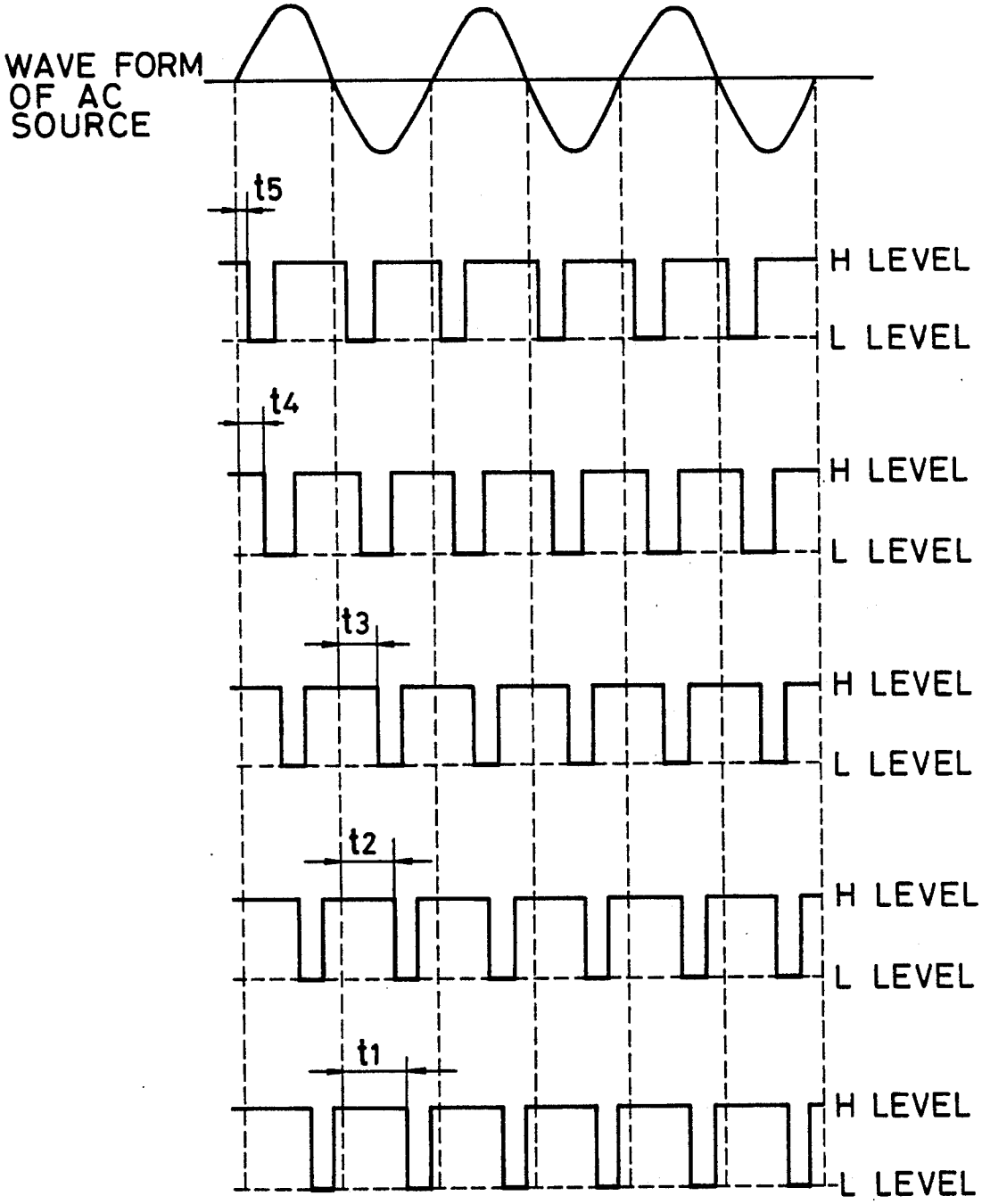
FIG. 16 is a timing diagram of a trigger signal of the air blower control bidirectional triode thyristor when the A notch is set.

V) From the comparison result, one of bidirectional triode thyristor trigger signal timing t1 to t5 shown in FIG. 16 is selected.

For example, when the value VA satisfies VPA2≦VA<VPA3, the bidirectional triode thyristor trigger signal is outputted at the time t3, and the notch indicating light emitting diodes D4, D5 and D6 light up. The trigger timing corresponds to the aforementioned other notches.

After that, a processing similar to that of the dust volume indication comparison in the other notches is performed.

Figure 17:
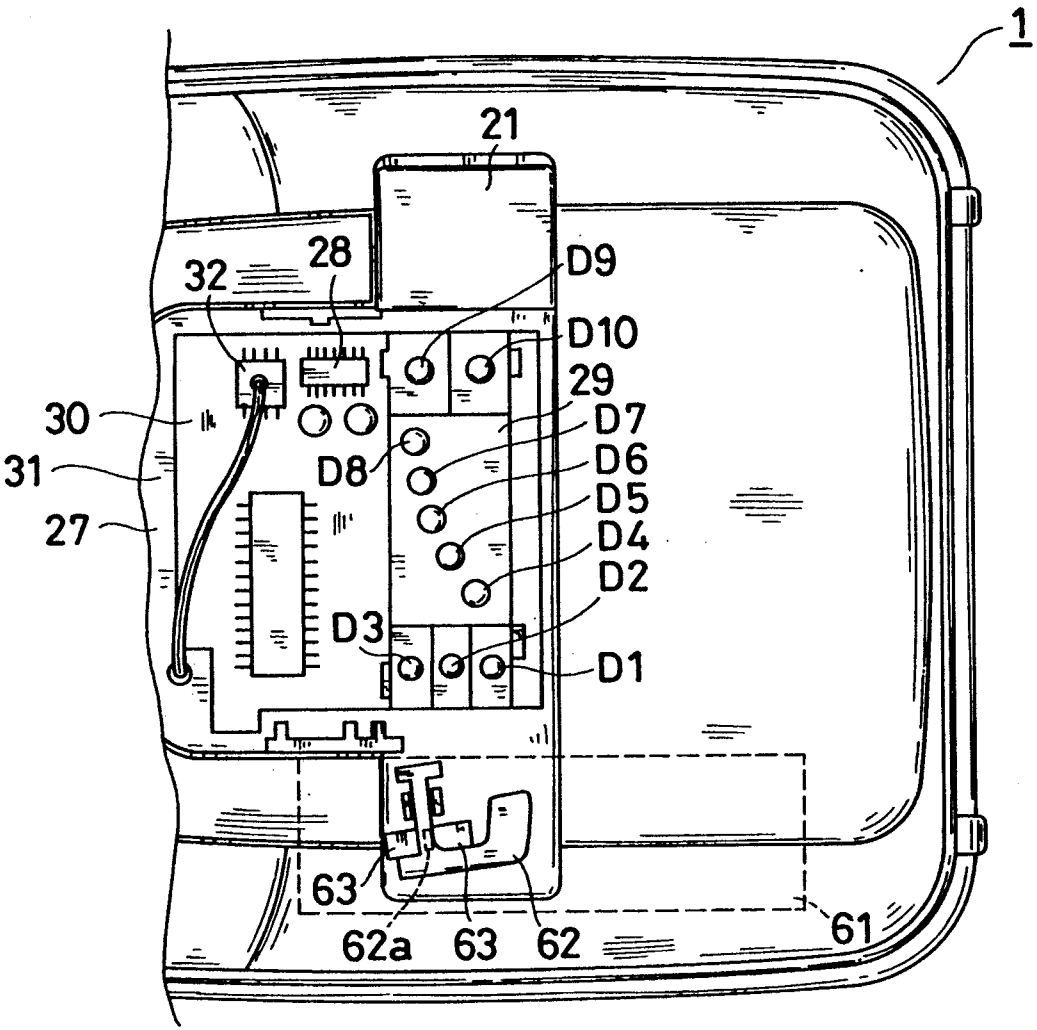
FIG. 17 is an elevational view showing a main portion of the inside of a control board housing unit.

Reference numeral 60 denotes a cord reel button disposed on the left in the upper face of the cleaner body 1. A cord reel take-up portion 61 for a retractable cord is disposed on the left in the center portion of the cleaner body 1, and a lever 62 used for taking up the cord is positioned at the back of the cord reel button. A bore 63 is formed in the control board housing unit 27 and a shaft 62*a* of the lever 62 is placed therethrough. A part of the discharged air which becomes hot because it cools the cord reel take-up portion 61 flows into the control board housing unit 27 through the bore 63. The semiconductor pressure sensor 32 which is very sensitive to temperature is disposed on the right portion remote from the bore 63 in the control circuit board 30 as shown in FIG. 17 so that it may not be affected by the heat.

In the cleaning operation, an accumulated state of dust within the filter 9 in the dust chamber 3 is digitally clearly indicated by the three green, orange and red markers SM1, SM2, SM3 in the dust meter 24, so that the dust volume can be visually confirmed at a glance. Additionally, when the dust within the filter should be emptied, namely, the filter 9 should be replaced with a new one, the markers SM1, SM2, SM3 light up and go out and the buzzer 42 makes a sound to inform the user of the filter replacement time, so that the user can always clean under the optimum condition. Moreover, the dust volume is visually confirmed because the markers SM1, SM2, SM3 give an indication with levels of colors. Also, since the dust volume is accurately indicated regardless of the selected notch varying the suction force of the electric air blower 7, the user can accurately know the dust volume.

Further, when the vacuum cleaner is displayed in the show window at a shop, manipulating a combination of a plurality of function switches, for example, a combination of the shutter switch SW3 and the mite killing operation switch SW1 allows the function indication unit 22 consisting of the dust meter 24, power control indicator 25 and mite killing indicator 26 to light up go and out in the indication mode regardless of the indication state in the cleaning mode. Thus, simple switch manipulation makes it possible to easily attain an effective indication. The function indication unit 22 itself can be used as an indication instrument for show window indication, and hence any special indication instrument will be unnecessary. Additionally, manipulating a particular combination of several cleaner function switches is required to turn the indication mode on, so that there is very little possibility to erroneously turn the indication mode on.

In the vacuum cleaner according to the present invention, particularly, a detected output from the the pressure sensor and a plurality of preset reference values are compared with one another, and the dust volume is digitally indicated with levels of markers lighting up based upon the comparison result, so that the user can confirm at a glance the state of dust in the dust chamber and the time when the dust should be emptied.

Further, since the reference values are preset corresponding to variations in the suction force of the electric air blower, the dust volume is accurately indicated regardless of the variations in the suction force of the electric air blower, and the user accurately can know the dust volume. In the aforementioned embodiment, the pressure sensor is disposed in the suction side of the electric air blower, namely, in the rear portion of the dust chamber, and a difference between a pressure detected by the pressure sensor and an ambient pressure is compared with the reference values so that the state of dust in the dust chamber is indicated based upon the comparison result. However, two pressure sensors may be disposed in the front and rear portions of the dust chamber, and an output of a difference between pressures detected by those sensors may be compared with the reference values, so that the state of dust in the dust chamber can be detected with higher accuracy.

What is claimed is:

1. A vacuum cleaner comprising:

a cleaner body provided with an air inlet and an air outlet;

a dust chamber provided in said cleaner body and communicating with said air inlet;

a housing provided in said cleaner body, communicating with said dust chamber and said air outlet and accommodating an electric air blower;

means for selecting inlet suction force levels produced by said electric air blower;

a pressure sensor in communication with the suction side of said electric air blower;

means for comparing an output of a detected pressure from said sensor with a reference value;

means for varying said reference value in proportion to the suction force level selected by said selecting means; and means for indicating an accumulated state of dust in said dust chamber based upon the comparison result from said comparing means.

2. A vacuum cleaner according to claim 1, wherein said reference value is settable to at least two different values, and said indication means indicates one of a plurality of levels of accumulated dust in said dust chamber.

3. A vacuum cleaner according to claim 1, wherein said reference value is settable to at least four different values, and said indicating means gives an indication of one of at least five levels.

4. A vacuum cleaner according to claim 1, wherein said indicating means includes a light emitting diode.

5. A vacuum cleaner according to claim 1, further comprising means for indicating the inlet suction force level selected by said selecting means.

6. A vacuum cleaner according to claim 1, wherein said comparing means compares a sample value of said output with said reference value, the sample value being the maximum output obtained by sampling outputs from said pressure sensor a plurality of times within a predetermined period of time.

7. A vacuum cleaner according to claim 1, wherein functioning of said comparing means is initiated after the level of suction force selected by said selection means is stabilized.

* * * * *